United States Patent [19]

Maisch et al.

[11] Patent Number: 4,620,520

[45] Date of Patent: Nov. 4, 1986

[54] APPARATUS FOR CONTROLLING RECIRCULATED EXHAUST GAS QUANTITIES IN INTERNAL COMBUSTION ENGINES

[75] Inventors: Wolfgang Maisch, Schwieberdingen; Wolfgang Schäfer, Grossbottwar, both of Fed. Rep. of Germany

[73] Assignee: Robert Bosch GmbH, Stuttgart, Fed. Rep. of Germany

[21] Appl. No.: 733,425

[22] Filed: May 13, 1985

[30] Foreign Application Priority Data

Aug. 1, 1984 [DE] Fed. Rep. of Germany ..... 3428380

[51] Int. Cl.[4] ..... F02M 25/06

[52] U.S. Cl. ..... 123/571; 123/568

[58] Field of Search ..... 123/511, 568, 569, 571, 123/587; 137/DIG. 8, 115, 116, 510

[56] References Cited

U.S. PATENT DOCUMENTS

| | | | |
|---|---|---|---|
| 4,009,700 | 3/1977 | Engels et al. | 123/571 X |
| 4,150,648 | 4/1979 | Ogita | 123/568 |
| 4,177,777 | 12/1979 | Maruyama et al. | 123/571 |
| 4,271,811 | 6/1981 | Suzuki et al. | 123/571 |
| 4,353,385 | 10/1982 | Maisch et al. | 123/511 X |
| 4,367,720 | 1/1983 | Miyoshi et al. | 123/571 |
| 4,495,922 | 1/1985 | Fujimura et al. | 123/587 X |

*Primary Examiner*—Willis R. Wolfe

*Attorney, Agent, or Firm*—Edwin E. Greigg

[57] ABSTRACT

An apparatus is proposed which serves to control the quantity of exhaust gas recirculated from the exhaust gas system of an internal combustion engine to its intake side. The apparatus includes a pneumatic final control element having a diaphragm defining a work chamber, the diaphragm arranged to actuate a valve closing member of an exhaust gas recirculation (EGR) valve. Via a control pressure line, a flow line leading to the atmosphere and a connecting line leading to the intake tube downstream of a throttle valve are connected to the work chamber. A check valve opening toward the intake tube, a reservoir and a throttle restriction are disposed in the connecting line. A bypass line having a bypass valve bypasses the throttle restriction. Disposed in the flow line is an electrofluid converter of the nozzle/bounce plate type, by means of which, triggered by an electronic control unit in accordance with operating variables of the engine, a predetermined pressure drop between the atmosphere and the pressure in the work chamber can be established.

6 Claims, 1 Drawing Figure

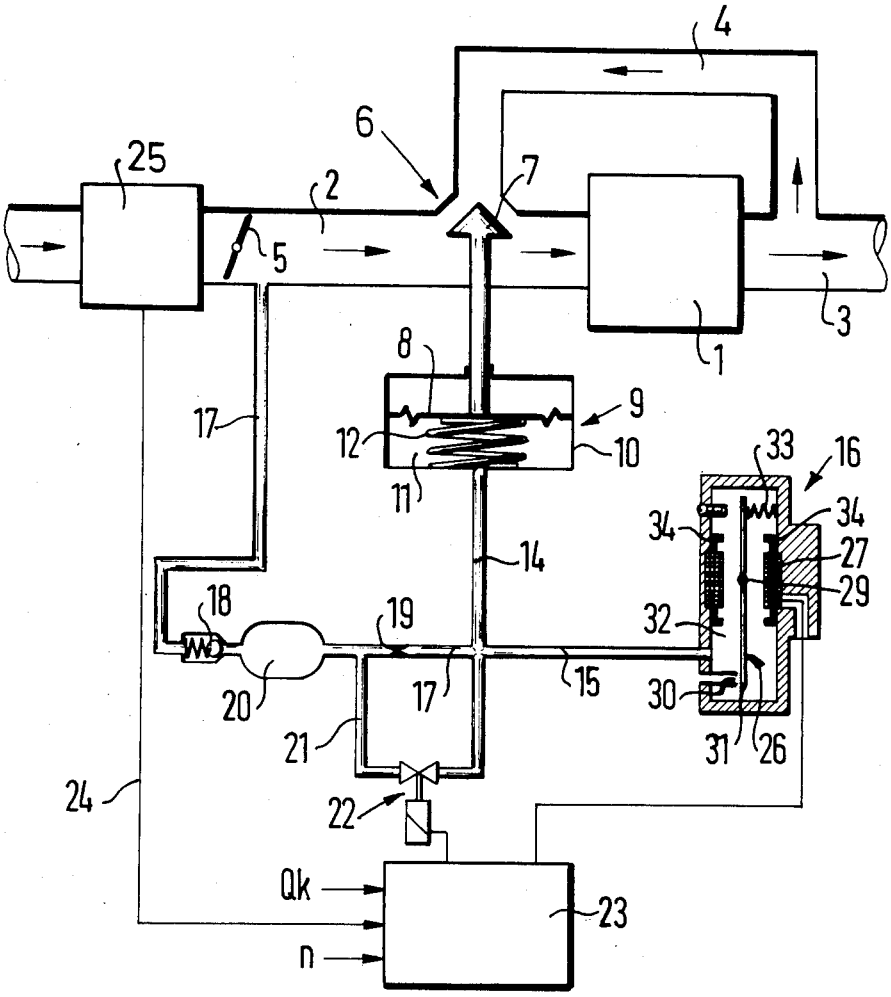
4
6
25
2
7
5
3
1
8
9
17
12
10
11
33
16
34
34
27
29
14
18
19
32
20
17
15
30
21
31
26
24
22
Qk
23
n

APPARATUS FOR CONTROLLING RECIRCULATED EXHAUST GAS QUANTITIES IN INTERNAL COMBUSTION ENGINES

BACKGROUND OF THE INVENTION

The invention is based on an apparatus for controlling recirculated exhaust gas quantities as defined hereinafter. An apparatus is already known for controlling recirculated exhaust gas quantities (U.S. Pat. No. 4,177,777), in which the control pressure is formed with the aid of a magnetic valve that controls a connection to the ambient air, so that the control pressure of a pneumatically actuatable exhaust gas recirculation (EGR) valve is varied, and the magnitude of the recirculated exhaust quantity is controlled thereby. The disadvantage, however, is that with the opening cross section of the magnetic valve remaining constant, the pressure prevailing in the work chamber of the pneumatic final control element of the EGR valve also varies when there is a change in the difference between the atmospheric pressure and the pressure in the intake tube downstream of the throttle valve, causing undesirable changes in the exhaust gas recirculation rates.

OBJECT AND SUMMARY OF THE INVENTION

The apparatus according to the present invention has the advantage over the prior art that more accurate and rapid control of the exhaust gas recirculation rate is effected, yet the triggering electronics are simpler and less expensively embodied.

Advantageous further embodiments of and improvements to the apparatus disclosed in this application are attainable by means of the provisions delineated herein.

A particularly advantageous feature of the invention makes it possible to select a smaller cross section of the throttle restriction, thus attaining rapid triggering of the pneumatic final control element and a rapid decrease or increase in the exhaust gas recirculation rate when the throttle valve is suddenly actuated.

In a further embodiment of the invention it is advantageous that, if there is a sudden opening of the throttle valve, it is possible to assure that a sufficient pressure difference will still be available, for a predetermined period of time, for triggering the pneumatic final control element.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows an exemplary embodiment of the invention in a simplified schematic form.

DESCRIPTION OF THE PREFERRED EMBODIMENT

The drawing shows an internal combustion engine 1 in simplified form, having an intake system 2 and an exhaust manifold system 3. From the exhaust manifold system 3, an exhaust gas recirculation (EGR) line 4 leads to the intake tube 2 downstream of a throttle valve 5 of the intake system. In the EGR line or, as shown, at the mouth of the EGR line 4 into the intake tube 2, an EGR valve 6 is provided, its valve closing member 7 cooperating as a valve seat with the mouth of the EGR line 4. The valve closing member 7 communicates with a movable wall 8 of a pneumatically operating final control element 9. The final control element 9 conventionally comprises a housing 10, in which a work chamber 11 is defined on one end, for instance by means of a diaphragm 8 which acts as the movable wall. A restoring spring 12 is disposed in the work chamber 11 and supported at one end of the diaphragm 8. The work chamber 11 communicates with a control pressure line 14, into which a flow line 15 that leads to the atmosphere discharges. An electrofluid converter 16 of the nozzle/bounce plate type is disposed in the flow line 15. Furthermore, the control pressure line 14 is arranged to communicate with a connecting line 17, which discharges downstream of the throttle valve 5 at the intake tube 2. Disposed in the connecting line 17, remote from the intake tube 2, are a check valve 18 which opens in the direction toward the intake tube 2 and a throttle restriction 19 which extends toward the control pressure line. Between the check valve 18 and the throttle restriction 19, the connecting line 17 leads through a negative pressure reservoir 20. A bypass line 21 leads from the connecting line 17 to the control pressure line 14, bypassing the throttle restriction 19. Disposed in the bypass line 21 is an electromagnetically actuatable bypass line 22, which is triggerable by means of an electronic control unit 23 which also triggers the electrofluid converter 16. The electronic control unit 23 is supplied in a known manner with operating variables of the engine in the form of electrical signals, for instance an rpm signal n, a load signal $Q_k$ and, via a control signal line 24, an air flow rate signal from an air flow rate meter 25 disposed in the intake system 2.

The electrofluid converter 16 is known per se in its structure, for instance from German Offenlegungsschrift No. 31 09 560. Therefore the present discussion will only briefly address the function and mode of operation of the electrofluid converter 16. The electrofluid converter 16 includes a rocker 26, which is acted upon electromagnetically, by means of a coil 27, with a variable deflection moment, so that it undergoes a certain deflection about an axis of rotation 29. As illustrated the flow line 15 connects with the electrofluid converter and this latter member is open to ambient air through nozzle 30. The nozzle 30 may by closed to a variable extent by means of an end of the rocker 26 serving as a bounce plate 31, so that depending upon how far it is opened, more or less air can flow from the atmosphere via the nozzle 30 into an inner chamber 32 of the electrofluid converter 16. It will be noted that the chamber 32 communicates via the flow line 15 with the control pressure line 14. The rocker 26 operates counter to a spring means 33. Via yokes 34—34 and associated poles, a permanent magnetic field generated by a permanent magnet acts upon the rocker 26, resulting in a basic moment at the rocker. Thus at a constant deflection moment engaging the rocker 26, a pressure drop is generated between the nozzle 30 and the bounce plate 31, and this pressure drop is so large that a constant pressure difference, which is dependent on the deflection moment, is established between the ambient air pressure and the pressure in the flow line 15 and thus in the work chamber 11. Because of the spring forces and/or magnetic forces exerted, the electrofluid converter 16 of the nozzle/bounce plate type thus regulates a predetermined desired pressure difference, dictated by the control signal of the electronic control unit 23, between the atmospheric pressure and the pressure in the work chamber 11; especially in idling operation and at low partial load of the engine 1, this pressure difference is independent of variations in atmospheric air pressure or in the pressure in the connecting line 17. This is because both the atmospheric air pressure and the pressure in the work chamber 11 influence the rocker 26 and, together with the restoring spring forces and/or magnetic forces, they effect a balance of forces. By means of the electrofluid converter 16 it is thus possible to regulate a control pressure in the work chamber 11 very accurately in accordance with the control current delivered to the electronic control unit 23, and thus to control the EGR rate effected by the EGR valve 6 very accurately.

The pressure difference prevailing between the intake tube 2 and the atmospheric pressure is divided by the throttle restriction 19 and the electrofluid converter 16, which functions as a differential pressure regulator. The check valve 18 and the negative pressure reservoir 20 have the task of assuring a desired triggering of the EGR valve 6 in the opening direction for a predetermined period, that is, until the negative pressure reservoir is filled, whenever the throttle valve 5 in the intake line 2 is suddenly opened.

In this case, the pressure downstream of the throttle valve 5 in the intake tube 2 rises to virtually atmospheric pressure, and the check valve 18 closes. The pressure divider, comprising the throttle restriction 19 and the electrofluid converter 16, can now continue to operate and to trigger the EGR valve 6 until such time as the negative pressure reservoir 20 is filled. If the throttle valve 5 is closed again, then the pressure in the intake tube 2 drops and thus the pressure at the check valve 18 on its side remote from the negative pressure reservoir 20 drops as well, and the check valve 18 opens, so that the negative pressure reservoir 20 empties again. Simultaneously with the opening of the throttle valve 5, the bypass valve 22 can be opened, so that via the bypass line 21, a negative pressure can build up very rapidly in the work chamber 11, and the EGR valve 6 can be opened. The opening duration of the bypass valve 22 can be defined by a timing element, which is for instance provided in the electronic control unit 23. It is also possible, for example, to use a rapid rise in the control current of the electrofluid converter 16, in which case the bounce plate 31 virtually closes the nozzle 30, as a control signal for the bypass valve 22. The arrangement of the bypass line 21 with the bypass valve 22 has the advantage that the throttle restriction 19 can be provided with a very small cross section. This provision has the result that if needed, the pressure in the work chamber 11 can be varied quickly by actuating the bypass valve 22 in accordance with engine operating variables, and the EGR valve 6 can be moved rapidly.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An apparatus for controlling the quantity of exhaust gas recirculated from an exhaust system of an internal combustion engine to an intake system including an intake tube thereof comprising an exhaust gas recirculation line connected with said exhaust tube including an exhaust gas recirculation valve, a pneumatically operating final control element provided with a movable part connected to a valve closing member of said exhaust gas recirculation (EGR) valve, said final control element including a work chamber, said work chamber defined on one side by said movable part, and a further part arranged to communicate via a throttle restriction with said intake tube downstream of a throttle valve in said intake tube and via a valve assembly having at least one pressure source, said valve assembly further controllable by control signals of an electronic control unit in accordance with operating variables of said engine, said valve assembly further including an electrofluid converter of a nozzle/bounce plate type, which is located in a flow line adapted to communicate with atmospheric pressure and with said work chamber, whereby control signals of said electronic control unit regulate a pressure difference associated with said control signals between said atmospheric pressure and pressure in said work chamber.

2. An apparatus as defined in claim 1 wherein said exhaust gas recirculation line forms a mouth with said intake tube and said mouth forms a valve seat for said valve closing member connected to said movable part of said final control element.

3. An apparatus as defined by claim 1, further wherein a connecting line leads from said intake tube downstream of said throttle valve to said throttle restriction, a bypass line bypassing said throttle restriction and communicating through a valve means with said work chamber.

4. An apparatus as defined by claim 3, further wherein said valve means comprises a bypass valve and said bypass valve is openable for a predetermined period of time whenever said throttle valve is moved into a position opening said intake tube.

5. An apparatus as defined by claim 3, further wherein said connecting line from said intake tube is provided a check valve opening toward said intake tube and a negative pressure reservoir between said check valve and said throttle restriction.

6. An apparatus as defined by claim 5, further wherein said valve means is openable for a predetermined period of time whenever said throttle valve is moved into a position opening said intake tube.

* * * * *